US006685507B2

(12) United States Patent
Piovesan

(10) Patent No.: US 6,685,507 B2
(45) Date of Patent: Feb. 3, 2004

(54) ELECTRICAL CONNECTOR

(75) Inventor: Gianni Piovesan, Cadoneghe (IT)

(73) Assignee: Inarca S.p.A., Vigodarzere (IT)

( * ) Notice: Subject to any disclaimer, the term of this patent is extended or adjusted under 35 U.S.C. 154(b) by 0 days.

(21) Appl. No.: 10/024,141

(22) Filed: Dec. 26, 2001

(65) Prior Publication Data

US 2002/0094720 A1 Jul. 18, 2002

(30) Foreign Application Priority Data

Jan. 16, 2001 (IT) ..... PD01A0010

(51) Int. Cl.[7] ..... H01R 13/40
(52) U.S. Cl. ..... 439/596; 439/937
(58) Field of Search ..... 439/596, 590, 439/594, 937, 404

(56) References Cited

U.S. PATENT DOCUMENTS 3,836,944 A 9/1974 Lawson
4,759,723 A * 7/1988 Siemon ..... 439/596
4,767,353 A 8/1988 Hughes et al.
4,998,893 A * 3/1991 Mantlik ..... 439/937
5,159,156 A * 10/1992 Munk et al. ..... 439/937
5,664,967 A * 9/1997 Hatagishi et al. ..... 439/596
6,007,366 A * 12/1999 Torii et al. ..... 439/404
6,059,613 A * 5/2000 Feher et al. ..... 439/937
6,109,975 A * 8/2000 Nitta ..... 439/596
6,244,899 B1 * 6/2001 Bogursky et al. ..... 439/937

* cited by examiner

*Primary Examiner*—Gary Paumen
(74) *Attorney, Agent, or Firm*—Guido Modiano; Albert Josif; Daniel O'Byrne

(57) ABSTRACT

An electrical connector comprising a body made of plastics in which there are multiple side-by-side cavities, which in turn form seats that accommodate electrical terminals and ends of cables wired to the terminals; a cover is coupled to the body by way of flexible straps, and respective complementary male and female tabs protrude from the ends of the cover for series engagement so as to form belts for winding on reels.

6 Claims, 3 Drawing Sheets

ELECTRICAL CONNECTOR

BACKGROUND OF THE INVENTION

The present invention relates to an electrical connector.

It is known that currently connectors are used increasingly to accommodate electrical terminals to be connected to electrical connection wires.

In particular, these connection assemblies are used in mass-production wiring.

For this purpose, wiring machines are commercially available which automatically connect the electrical wires and the metallic terminals.

In order to allow the wiring machines to operate adequately, they must be supplied with corresponding terminals and connectors as simply and effectively as possible.

Feeding individual connectors was found immediately to be inadequate for wiring machines, due to the problems related to solving the supply dynamics and because these machines require a continuous supply stream at a very high rate.

Accordingly, packs constituted by a plurality of connectors arranged side by side in succession in hollow elongated supports have been provided.

However, this solution is not ideal due to the rigidity of the packs and to the difficulties encountered in handling them.

In order to obviate the problems of feeding connector packs in automatic machines (and the high product costs), reels constituted by a plurality of connectors connected to each other by mutual engagement have been provided.

SUMMARY OF THE INVENTION

The aim of the present invention is to provide a connector that has engagement means for providing belt-like series in order to feed wiring machines adequately and effectively.

Within this aim, an object of the present invention is to provide a connector which, when joined in series to other connectors, can be separated simply and quickly.

Another object of the present invention is to provide a connector whose application to the wiring operation can be substantially completely automated.

Another object of the present invention is to provide a connector that is economically competitive to manufacture with respect to known ones and which can be manufactured with known technologies.

This aim and these and other objects that will become better apparent hereinafter are achieved by an electrical connector, characterized in that it comprises a body made of plastics in which there are multiple side-by-side cavities, which in turn form seats that accommodate electrical terminals and ends of cables wired to the terminals, a cover being monolithically associated with said body by way of flexible straps, respective complementary male and female tabs protruding from opposite ends of said cover for series engagement so as to form belts for winding on reels.

BRIEF DESCRIPTION OF THE DRAWINGS

Further characteristics and advantages of the present invention will become better apparent from the description of an embodiment thereof, illustrated only by way of non-limitative example in the accompanying drawings, wherein.

DESCRIPTION OF THE PREFERRED EMBODIMENTS

Figure 2:
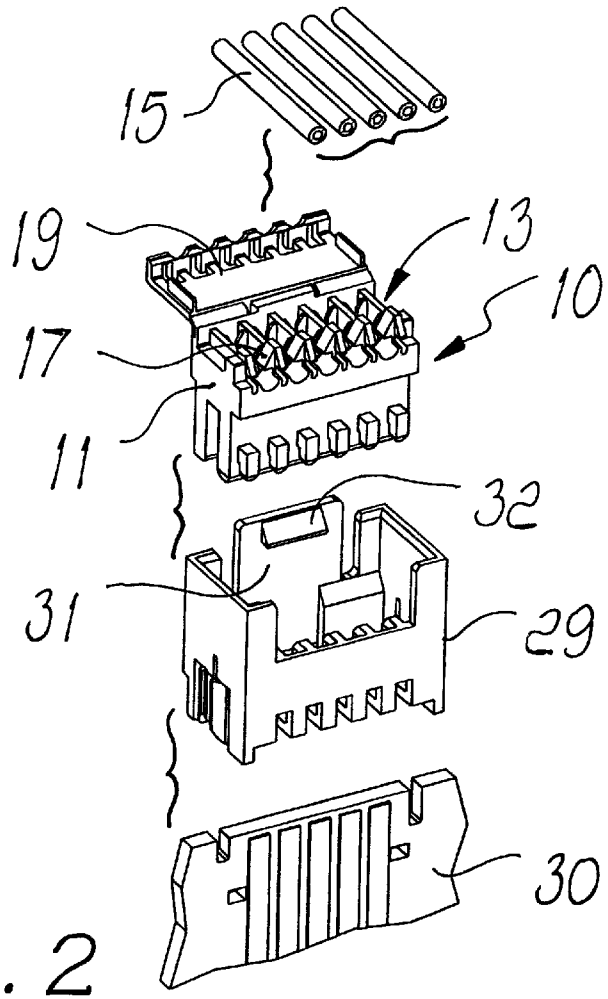
FIG. 2 is an exploded perspective view of the connector of FIG. 1.
Figure 1:
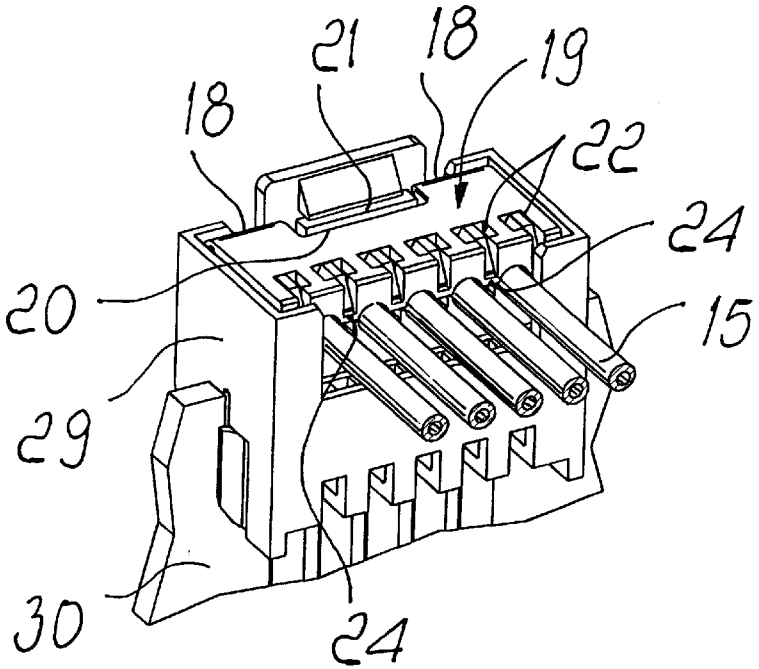
FIG. 1 is a perspective view of a connector according to the invention, assembled and wired on an electronic board.
Figure 3:
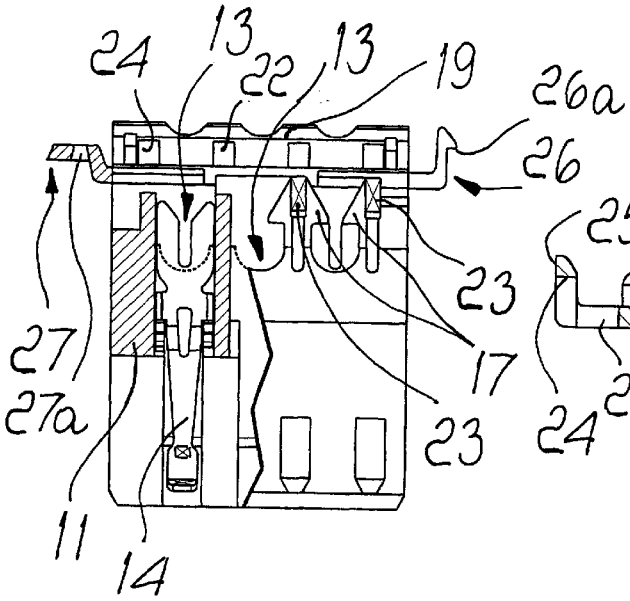
FIG. 3 is a partially sectional front view of the connector of FIG. 1.
Figure 4:
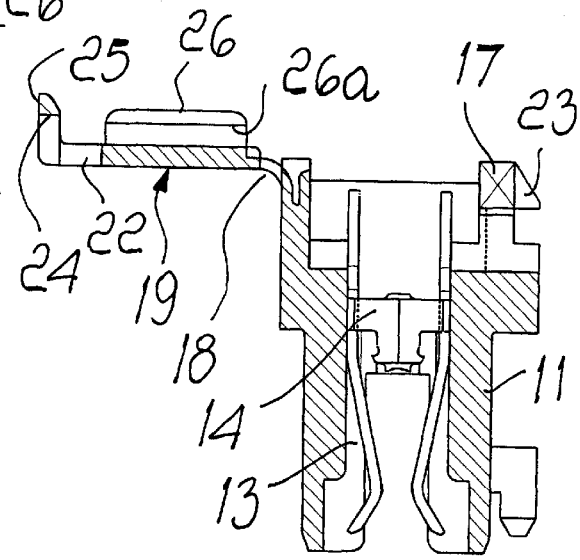
FIG. 4 is a transverse sectional view of the connector of FIG. 1.
Figure 5:
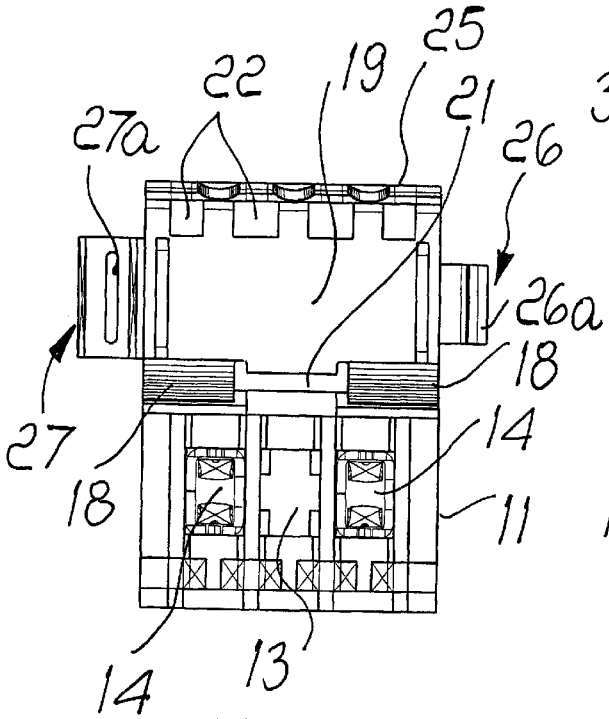
FIG. 5 is a plan view from above of the connector of FIG. 1.

With reference to the figures, an electrical connector is generally designated by the reference numeral 10.

Figure 6:
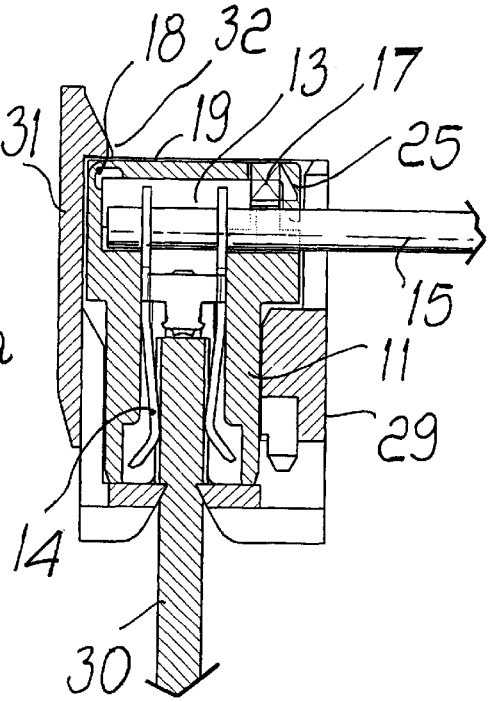
FIG. 6 is a transverse sectional view of the connector of FIG. 1, wired on an electronic board.
Figure 7:
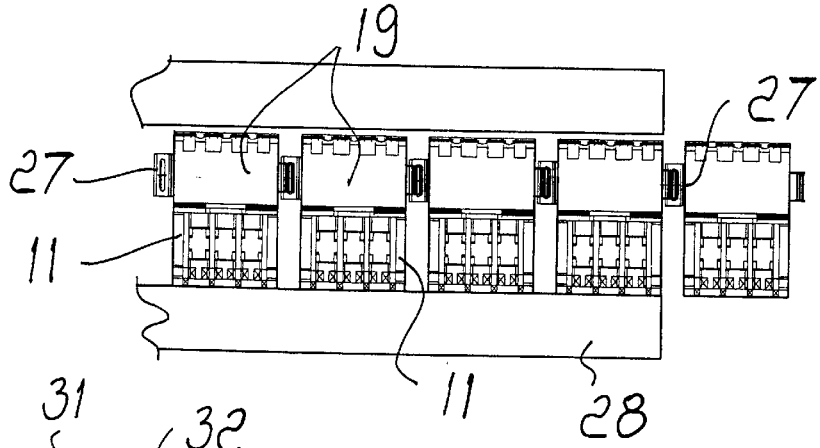
FIG. 7 is a view of a series of concatenated connectors according to the invention, between the walls of a takeup reel.
Figure 8:
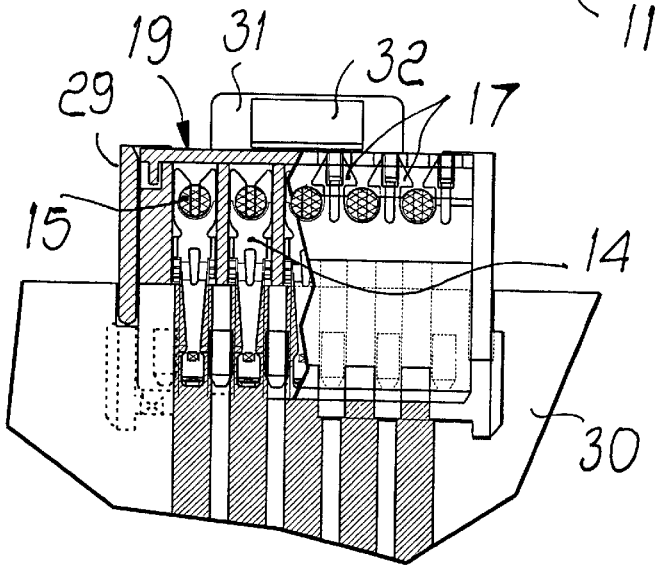
FIG. 8 is a front view of the connector of FIG. 1 applied to a board.
Figure 9:
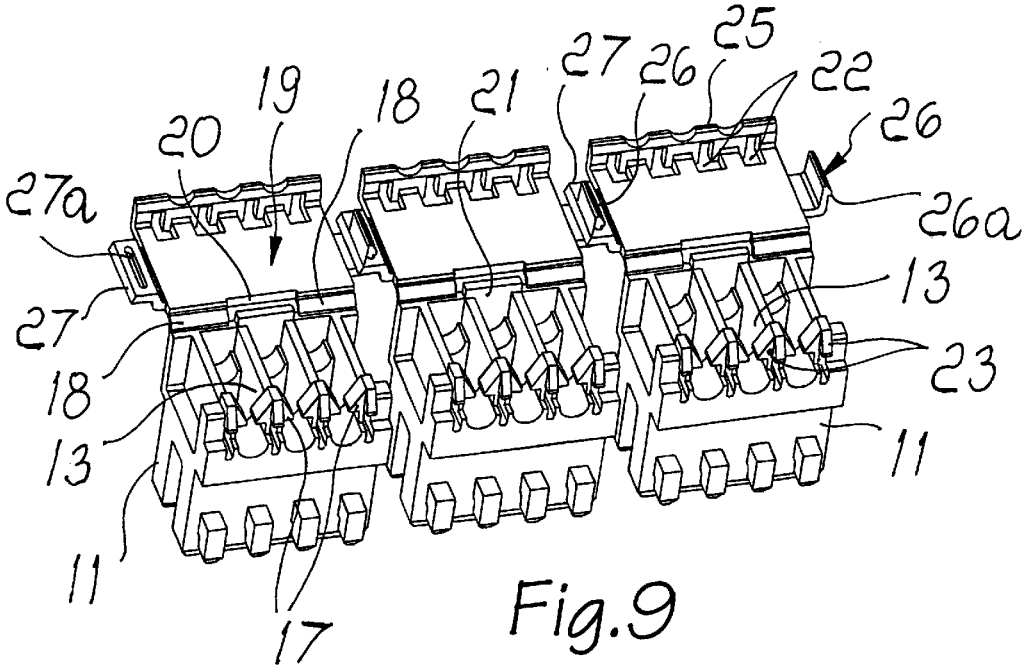
FIG. 9 is a perspective view of a series of concatenated connectors of FIG. 1.

The connector 10, in this case, is constituted by a body 11 made of plastics in which there are multiple side-by-side cavities 13, which in turn form seats that accommodate electrical terminals 14 and ends of cables 15 that are wired on the terminals 14, as shown in FIG. 6.

Retention teeth 17 having a triangular profile protrude at each one of the partitions 16 that separate two consecutive cavities 13, above the regions where the cables 15 are placed; such teeth facilitate the passage of the cables 15 (by elastic deformation thereof) and prevent their subsequent escape.

There are two teeth 17 for each region for accommodating a cable 15.

A cover 19 is rigidly coupled to the body 11 by means of two flexible straps 18.

The two straps 18 are separated, in the cover 19, by a hollow region 20, where an abutment tab 21 that protrudes from the body 11 is arranged.

The cover 19 has through holes 22, in which locking teeth 23 fit, having a triangular profile and protruding frontally from the body 11.

The teeth 23 act on abutments 24 formed on an edge 25 of the cover 19, forming bridges with the corresponding ends of the holes 22.

In practice, upon closing, the cover 19 flexes and the teeth 23 enter the holes 22 until they engage the abutments 24 and become coupled.

Respective complementary male and female tabs 26 and 27 for series engagement protrude from the opposite ends of the cover 19 for winding on reels 28 (when wiring is performed, the tabs 26 and 27 are cut from the covers 19).

The male tab 26 forms an angle ending with a retention tooth 26*a* that has a triangular profile.

The female tab 27 is flat, with a hole 27*a* for the insertion of the tooth 26*a* after elastic deformation.

As shown in the figures, the body 11 can be accommodated in a box-like female connector 29 made of plastics, which is connected for example to an electronic board 30.

The female connector 29 conveniently has, on a wing 31 obtained from a corresponding wall, a tooth 32, which has a triangular profile, protrudes inwardly and engages the abutment tab 21.

In practice, by inserting the body 11 in the female connector 29 the wing 31 flexes, because the tooth 32 interferes with the space occupied by the body 11, until the tooth 32 engages the tab 21.

In practice it has been found that the present invention has achieved the intended aim and objects.

In particular, it should be noted that the connectors engaged in series can form reels that can be used easily as the supply of wiring machines and allow ideal and optimum automation in the wiring process, allowing the machines provided for this operation to operate suitably.

It should also be noted that the connector according to the invention is usefully combined with a cover that is monolithic therewith.

The materials, so long as they are compatible with the contingent use, as well as the dimensions, may be any according to requirements.

The disclosures in Italian Patent Application No. PD2001A000010 from which this application claims priority are incorporated herein by reference.

What is claimed is:

1. A An electrical connector, comprising a body made of plastics in which there are multiple side-by-side cavities, which in turn form seats that accommodate electrical terminals and ends of cables wired to the terminals, a cover being monolithically associated with said body by way of flexible straps, respective complementary male and female tabs protruding from opposite ends of said cover for series engagement so as to form belts for winding on reels, said straps being two in number and being separated, in said cover, by a hollow region in which there is an abutment tab that protrudes from said body.

2. The connector according to claim 1, wherein retention teeth having a triangular profile protrude, above the regions where said cables axe arranged, at each one of the partitions that separate two consecutive cavities, said teeth facilitating the passage of the cables by elastic deformation thereof and preventing their subsequent escape.

3. The connector according to claim 2, wherein there are two opposite teeth for each cable accommodation region.

4. The connector according to claim 1, wherein said cover has through holes in which locking teeth having a triangular profile enter, said teeth protruding frontally from said body and acting on abutments provided on an edge of said cover, forming bridges with the corresponding ends of the holes, said cover flexing when it closes, causing the teeth to enter the holes until said teeth engage the abutments and become coupled.

5. The connector according to claim 1, wherein said male tab is angled and ends with a retention tooth that has a triangular profile.

6. The connector according to claim 5 wherein said female tab is flat, with a hole for the insertion of said tooth after elastic deformation.

* * * * *